United States Patent [19]

Shumaker

[11] 4,018,458

[45] Apr. 19, 1977

[54] VEHICLE STABILIZER WITH ADJUSTABLE FOOT

[75] Inventor: John F. Shumaker, Mount Pleasant, Iowa

[73] Assignee: J. I. Case Company, Racine, Wis.

[22] Filed: Sept. 22, 1975

[21] Appl. No.: 615,246

[52] U.S. Cl. ..... 280/766; 212/145; 248/357

[51] Int. Cl.[2] ..... B60S 9/12

[58] Field of Search ..... 280/763, 766, 761; 212/145; 248/357, 188.9

[56] References Cited

UNITED STATES PATENTS

| | | | |
|---|---|---|---|
| 2,987,290 | 6/1961 | Haarmann | 248/357 |
| 3,625,542 | 12/1971 | Curtis | 280/766 |
| 3,754,777 | 8/1973 | Riggs et al. | 280/766 |
| 3,901,532 | 8/1975 | Hornagold | 280/766 |

*Primary Examiner*—Joseph F. Peters, Jr.
*Assistant Examiner*—Michael J. Forman
*Attorney, Agent, or Firm*—Dressler, Goldsmith, Clement, Gordon & Shore, Ltd.

[57] ABSTRACT

A stabilizer for a vehicle is disclosed herein. The stabilizer consists of a pair of telescopic members with one member being mounted on the vehicle and the other member having a ground engaging foot supported on the free end thereof for rotation about a horizontal plane. The stabilizer incorporates latch means between the telescopic member and the foot for holding the foot in any number of rotated positions with respect to the telescopic member.

11 Claims, 7 Drawing Figures

10
20
12
18
32
30
16
14

36
44
34
46
76
5
5
56
54
94
74
92
72
82
78
76
84
90
64
50
58
66
60
52
62

VEHICLE STABILIZER WITH ADJUSTABLE FOOT

BACKGROUND OF THE INVENTION

The present invention relates generally to earthworking implements and more particularly to a stabilizing means for maintaining a stable condition for the vehicle during the operation of the implement. While not limited to any specific type of vehicle or implement, the invention is particularly suited for use as a stabilizing means for the rear end of a vehicle having a backhoe mounted thereon.

For years not it has been customary for manufacturers of earthworking implements to incorporate some type of stabilizing means on the vehicle which can be extended to offer stability when the implement is in operation. Various types of stabilizing means have been proposed in the past. One type of unit is what may be referred to as the pivotally mounted stabilizer wherein a pair of telescoping members are pivotally supported on the rear end of the vehicle and may be angularly adjusted with respect to a transverse axis on the vehicle.

Another type of stabilizing means that has been utilized consists of a pair of telescoping members, one of which is fixed with respect to the vehicle and positioned in a generally vertical direction with a second member telescoped within the first member. The outer end of the second member generally has some type of ground engaging foot secured thereto so that extension of the second member can raise the body of the vehicle to a position where the tires are above the ground.

In a conventional backhoe, it is customary to use a pair of stabilizers which are respectively located adjacent opposite sides of the vehicle.

One of the problems encountered in the design of such a unit is that all of the elements of the stabilizer means must be located within the transverse confines of the vehicle for transportation purposes. This is necessity limits the transverse spacing between the respective stabilizers. Furthermore, there are times when the position of maximum stability for the vehicle should be capable of being changed for varying ground conditions. Heretofore, this has not been possible with most commercially known stabilizers for vehicles.

SUMMARY OF THE INVENTION

According to the present invention, a stabilizer for a vehicle is designed so that the angular position of maximum stability for the vehicle can be varied through a simple adjustment between the stabilizer foot and the stabilizer beam.

More specifically, the stabilizer of the present invention includes first and second hollow tubular members that are telescoped with respect to each other and reciprocated through a drive means with a stabilizing foot concerned to the free end of one of the telescoping members. The stabilizing foot is mounted for rotation in a plane that extends perpendicular to the axis of the tubular member and incorporates latch means between the tubular member and the foot for holding the foot in any number of rotated positions with respect to the telescoping member.

In its preferred embodiment, the telescoping members are rectangular and the latch means consists of a rectangular collar slidably supported on the telescoping member and adapted to be received in a star-shaped recess formed in the upper surface of the foot. The star-shaped recess has a plurality of points, each of which can receive the corners of the collar so that the angular position of the foot with respect to the stabilizer can be varied. The latch means also has a flange extending from the periphery of the collar to cover the entire recess when the collar is positioned in the recess and preferably, releasable means are interposed between the collar and the foot to hold the collar in the recess.

DETAILED DESCRIPTION

Figure 1:
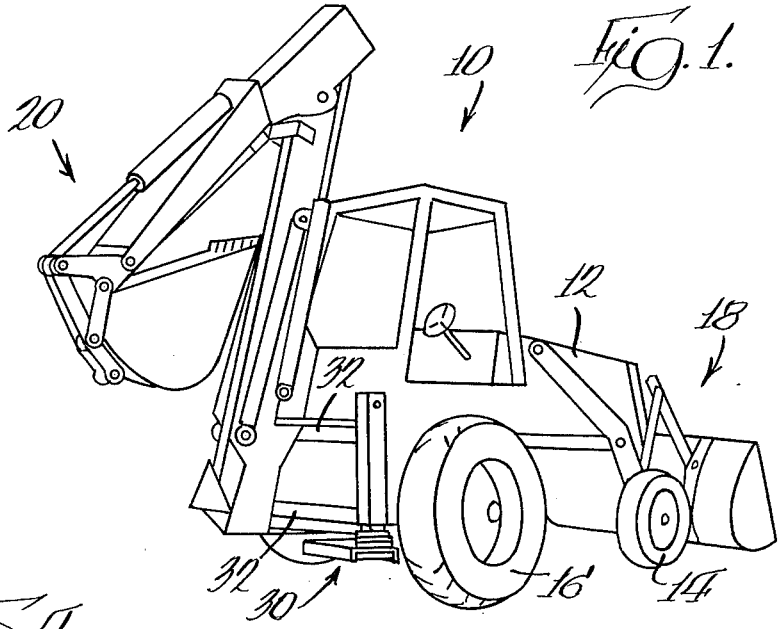
FIG. 1 is a perspective view of a vehicle having the stabilizer of the present invention incorporated therein.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiment illustrated.

FIG. 1 of the drawings generally indicates a vehicle 10 consisting of a generally rectangular body 12 supported by a pair of front wheels 14 and a pair of rear wheels 16 (only one of each being shown). Vehicle 10 has a bucket loader 18 mounted on the front end thereof and a backhoe 20 mounted on the rear end thereof. Since the bucket or front end loader 18 and the backhoe 20 are well known commercial units, no detailed description thereof appears to be necessary.

Vehicle 10 has stabilizer means at one end thereof consisting of first and second stabilizers 30 (only one being shown in FIG. 1) that are positioned at transversely spaced locations on the rear end of body 12. The two transversely spaced stabilizers 30 are interconnected by a pair of frame members 32 which are attached to the vehicle by means (not shown). Since the two stabilizers 30 are identical in construction, only one will be described in detail with particular reference to FIGS. 2 through 5.

Figure 2:
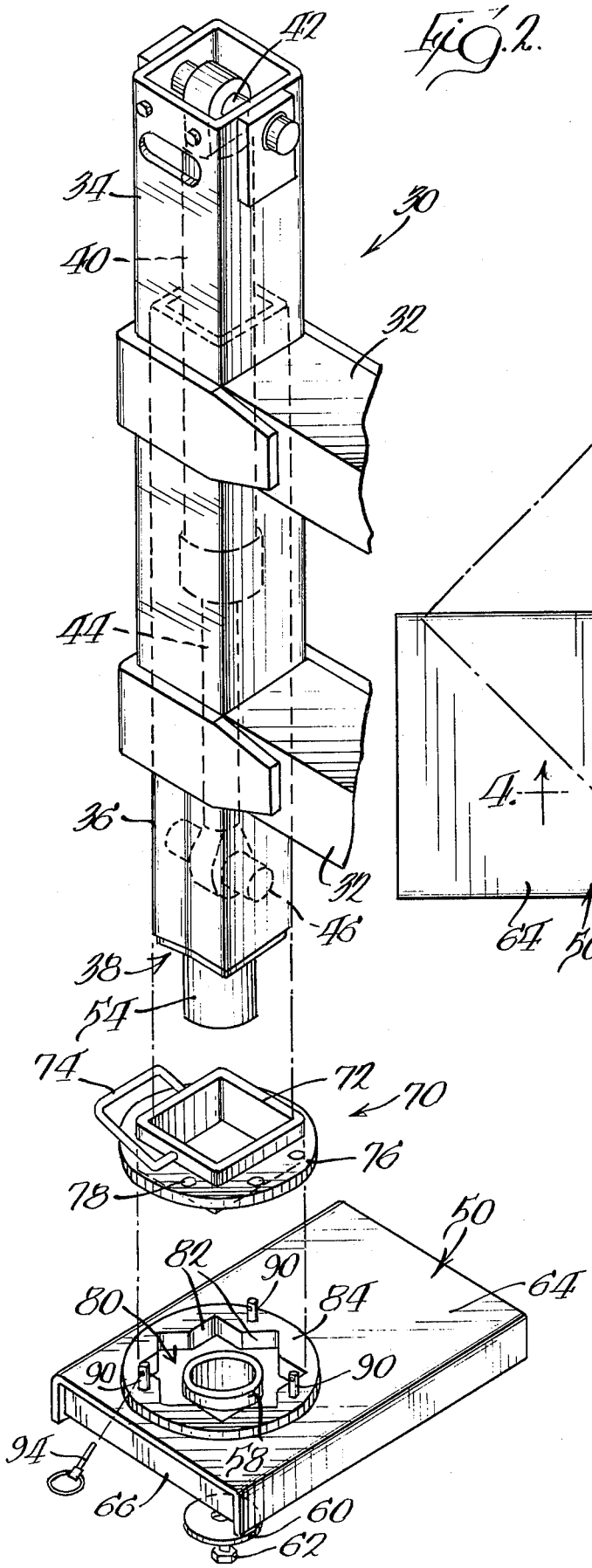
FIG. 2 is an exploded perspective view of the stabilizer of the present invention.
Figure 3:
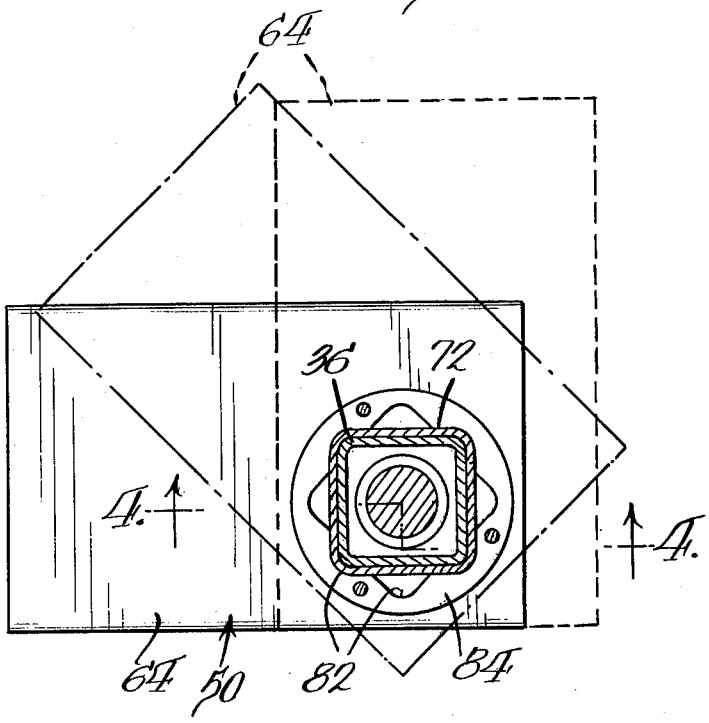
FIG. 3 is a horizontal section through a lower position of the stabilizer shown in FIG. 2.

Referring to FIG. 2, stabilizer 30 includes an elongated hollow tubular member 34 which is rectangular in cross-section and receives a telescoping member 36 that has a corresponding rectangular cross-section and is received through the lower open end 38 of tubular member 34 of reciprocal movement with respect thereto. The configuration of the respective tubular members 34 and 36 is such that the telescopic member 36 may be reciprocated with respect to tubular member 34 while the configuration prevents relative rotational movement of the two members.

The two members are extended and retracted relative to each other through a fluid ram consisting of a cylinder 40 pivotally connected at one end by a pin 42 to the upper end of the outer tubular member 34. The fluid ram also has a piston rod 44 reciprocated in cylinder 40 and has its free end connected by a pin 46 to the lower end of the inner telescoping member 36 so that extension and retraction of the fluid ram will extend and retract inner member 36 with respect to outer member 34.

Figure 4:
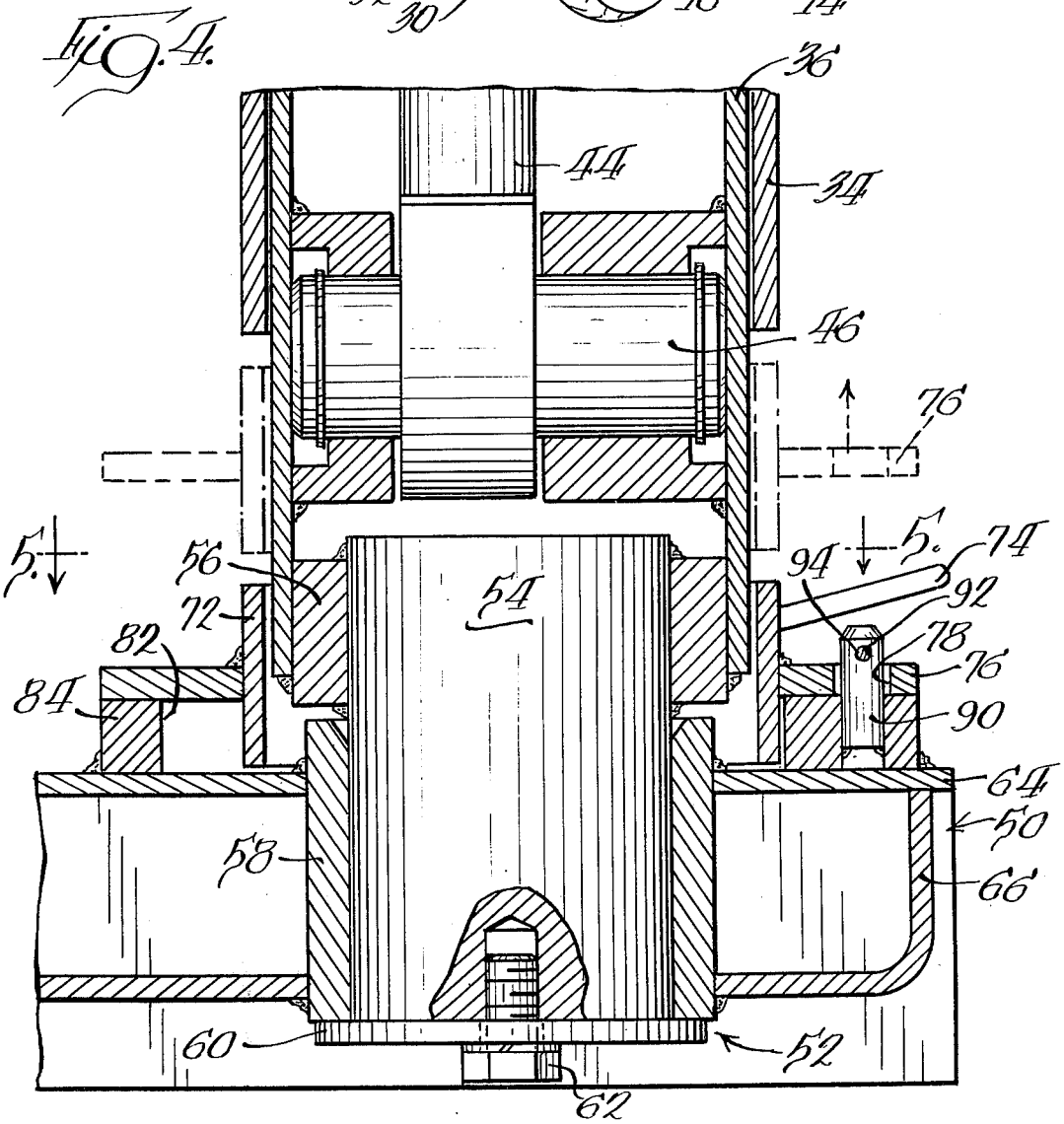
FIG. 4 is an enlarged fragmentary vertical section of the stabilizer as viewed along line 4—4 of FIG. 3.

According to the present invention, the lower free end of inner tubular member 36 has a ground engaging foot 50 secured thereto by mounting means 52 which rotatably supports foot 50 for rotation about an axis or plane that extends generally perpendicular to the axis of the telescoping member 36. As illustrated in FIGS. 2 and 4, this mounting means 52 consists of a stub shaft 54 that is fixedly secured to the lower free end of telescoping member 36 through a mounting structure 56 that may be welded to telescoping member 36 as well as to stub shaft 54 so that the stub shaft is fixed with respect to the lower free end of telescoping member 36. Stub shaft 54 extends through a sleeve 58 that is secured to foot 50, as by welding. An enlarged washer 60 is secured to the lower free end of stub shaft 54 through a bolt 62 so that ground engaging foot 50 is rotatably supported for rotation in a plane that extends generally horizontally and perpendicular to the longitudinal axis of members 34 and 36. As illustrated in FIG. 2, sleeve 58 is axially offset a substantial distance from the center of the rectangular foot 50, for a purpose that will be described later.

Foot 50 may take a variety of configurations but in the illustrated embodiment it is shown as including a substantially U-shaped plate 64 that has an upper web portion and a pair of downwardly directed legs at opposite edges of the web portion. A second substantially U-shaped plate 66 is located within the legs of U-shaped plate 64 and may be connected thereto, as by welding.

Foot 50 is held in any number of rotated positions with respect to telescoping member 36 by latch means 70 cooperating with telescoping member 36 and foot 50. Latch means 70 consists of a substantially rectangular collar 72 which has a dimension to be slidably supported in a nonrotatable position on the outer periphery of the lower free end of telescoping member 36. Telescoping collar 72 has a handle 74 secured thereto and a flange 76 extending from the periphery thereof with a plurality of circumferentially spaced openings 78 in the flange 76 for a purpose that will be described later.

The lower free end of collar 72 is adapted to be received into an enlarged recess 80 (FIG. 2), which is preferably star-shaped in cross-section and has a plurality of points, eight being illustrated in the preferred embodiment of the present invention. The respective points are configured and positioned so that four of the points 82 can receive the respective four corners of the rectangular collar 72 to hold foot 50 in a fixed angularly related position with respect to telescoping member 36. While recess 80 may be formed in any number of ways, preferably, such recess is formed in an upper plate 84 which is welded to the web of U-shaped plate 64. The plate 84 has a hole therein which defines the star-shaped opening described above.

Figure 5:
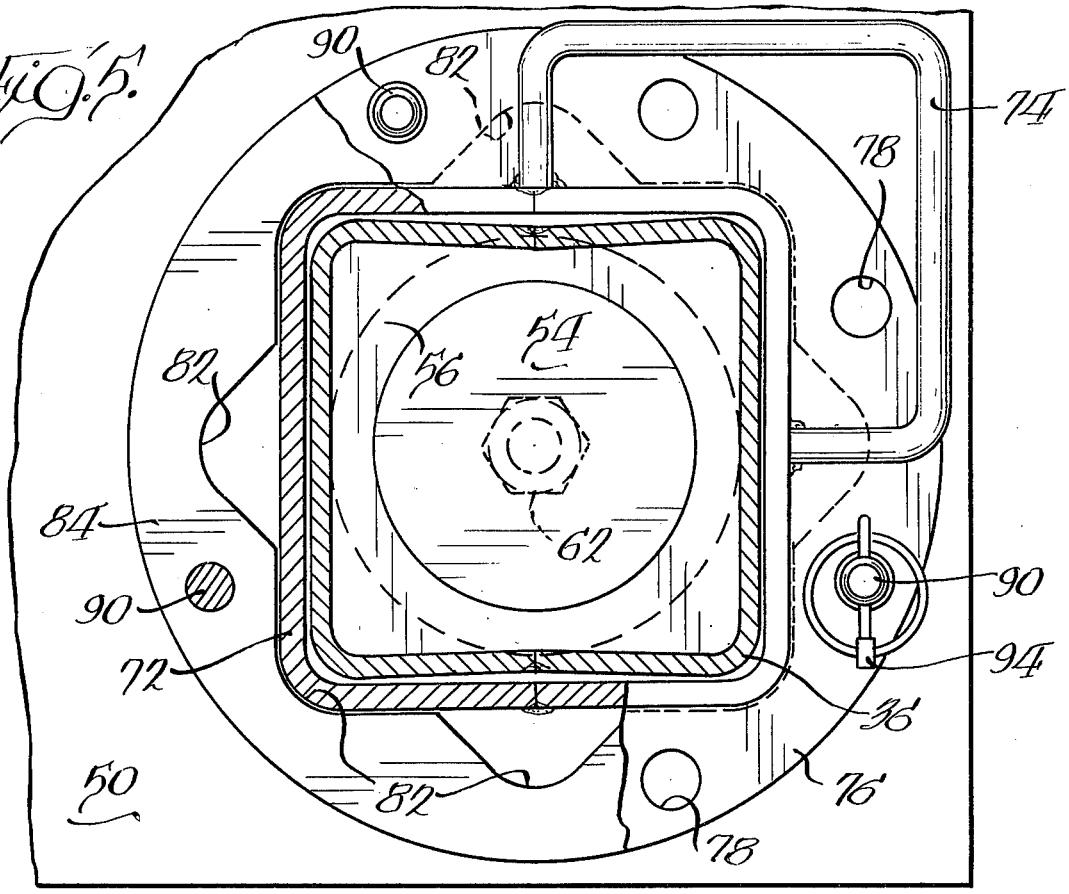
FIG. 5 is a horizontal section as viewed along line 5—5 of FIG. 4.

As illustrated in FIG. 5, when collar 72 is located within the recess defined in plate 84, the respective four corners of the rectangular collar are respectively received in altenate points 82 of star-shaped recess 80 so that the collar and the foot are in a nonrotatable position with respect to each other which also means that the foot is held in a substantially fixed position with respect to telescoping member 36 since the collar 72 is nonrotatable with respect to the axis of telescoping member 36. Thus, with an eight-point star-shaped recess, the operator can adjust foot 50 to eight angularly related positions with respect to the axis of telescoping member 36, three such positions being illustrated in FIG. 3.

The latch means of the present invention preferably also has releasable means between the collar and the foot for maintaining the collar within the recess. This means has been illustrated as including a plurality of pins 90 projecting upwardly above the upper surface of apertured sleeve 84 through openings 78 in flange 76. The upper ends of pins 90 have transverse openings 92 which receive cotter pins or klik pins 94 to lock collar 72 within recess 80.

As can be appreciated from the above description, the present invention provides a unique arrangement for allowing for rapid adjustment of the stabilizer foot 50 with respect to the remainder of stabilizer 30 so that the maximum stability for vehicle 10 may be varied depending upon the ground conditions. If it is desired to change the angular position of foot 50 with respect to telescoping members 34 and 36, it is only necessary for the operator to remove pins 94, slide collar 72 upwardly to the phantom-line position shown in FIG. 4 and then rotate foot 50 with respect to telescoping member 36 to the desired angular position where the respective corners of the collars are vertically aligned with the points 82 of star-shaped recess 80. The collar can then be dropped into the recess and locked into position by replacing cotter pins 94.

Figure 6:
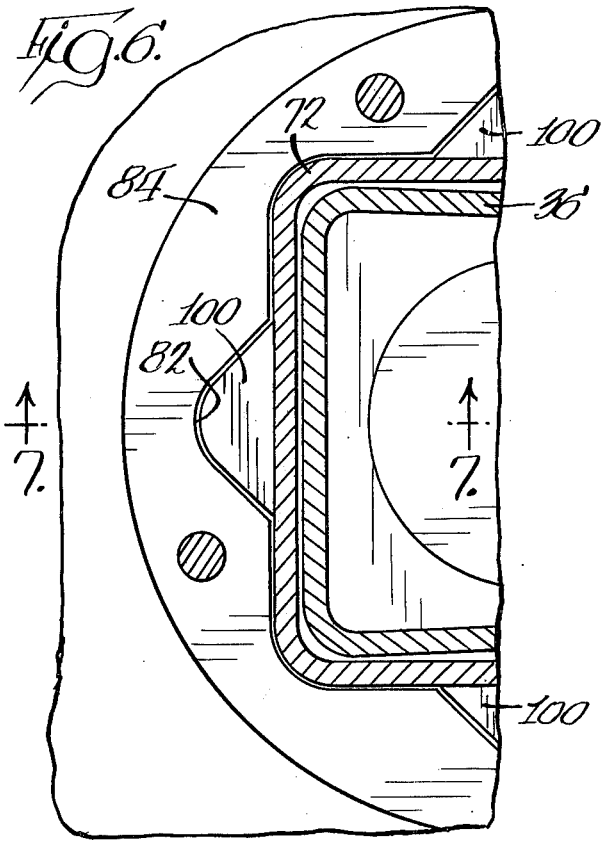
FIG. 6 is an enlarged fragmentary sectional view similar to FIG. 3 showing a slight modification of the invention.
Figure 7:
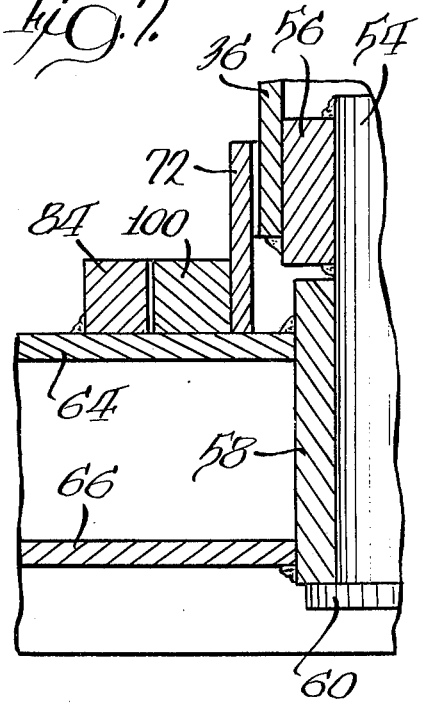
FIG. 7 is a fragmentary sectional view, as viewed along line 7—7 of FIG. 6.

If additional rigidity against nonrotational movement of the foot with respect to the telescoping member 36 is desired, additional triangular shape plates 100 may be welded to the flat peripheral wall portions of the collar 72 to be in vertical alignment with the remainder of the points 82 of the star-shaped recess 80, as illustrated in FIGS. 6 and 7.

Of course, it will be appreciated that only an illustrative embodiment of the invention has been described. For example, the length of foot 50 could be varied, within limits, to increase the amount of lateral offset of the foot 50 with respect to telescoping member 36.

What is claimed is:

1. A stabilizer for a vehicle comprising an elongated hollow tubular member having an open end, a telescopic member extending through said open end and disposed for reciprocable movement with respect thereto, drive means between said members for reciprocating said members with respect to each other, a ground engaging foot, mounting means rotatably supporting said foot for rotation on a free end of said telescopic member about an axis generally parallel to the telescopic member at said free end thereof with a center of said foot being laterally offset from said axis, and latch means between said telescopic member and said foot for holding said foot in a plurality of rotated positions with respect to said telescopic member.

2. A stabilizer as defined in claim 1, in combination with a vehicle having a generally rectangular body and wherein there are a pair of stabilizers as defined in claim 1, respectively located adjacent two adjacent corners of said body.

3. A stabilizer for a vehicle comprising an elongated hollow tubular member having an open end, a telescopic member extending through said open end and disposed for reciprocable movement with respect thereto, drive means between said members for reciprocating said members with respect to each other, a ground engaging foot, mounting means rotatably supportng said foot for rotation on a free end of said telescopic member about an axis generally parallel to the telescopic member at said free end thereof with a center of said foot being laterally offset from said axis, and latch means between said telescopic member and said foot for holding said foot in a plurality of rotated positions with respect to said telescopic member, said tubular member and said telescopic member being rectangular in cross-section and said latch means including a collar slidably supported on the periphery of said telescopic member and engaging said foot.

4. A stabilizer as defined in claim 3, in which said collar is rectangular in cross-section and said foot has an enlarged recess for receiving said collar to hold said foot with respect to said telescopic member.

5. A stabilizer as defined in claim 4, in which said recess is star-shaped in cross-section and has points for receiving respective corners of said rectangular collar.

6. A stabilizer as defined in claim 5, in which said star-shaped recess has eight points and said points are positioned so that said foot can be locked in eight adjusted positions with respect to said telescopic member.

7. A stabilizer as defined in claim 5, in which said collar has a flange extending from the periphery thereof with said flange covering said recess when said collar is in a latched position.

8. A stabilizer as defined in claim 7, further including releasable means between said foot and said flange for maintaining said collar in said recess.

9. In an elongated vehicle having stabilizer means at one end thereof, said stabilizer means including a pair of stabilizers transversely spaced at one end of said vehicle, each of said stabilizers including a hollow tubular member rectangular in cross-section, said member extending vertically with respect to said vehicle and having a lower open end, a rectangular telescopic member extending through said open end with drive means for reciprocating said members, a ground engaging foot, mounting means for supporting said foot for rotation in a horizontal plane on a free end of said telescopic member with its center laterally offset with respect to an elongated axis of said members, and latch means between said foot and telescopic member for holding said foot in a plurality of angularly related positions with respect to said telescopic member, said latch means including a collar rectangular in cross-section and slidably supported on the periphery of the free end of said telescopic member and said foot having a star-shaped recess having points for receiving respective corners of said collar.

10. A vehicle as defined in claim 9, further including a flange extending from the periphery of said collar and covering said recess when said collar is in said recess.

11. A vehicle as defined in claim 10, further including releasable means between said collar and said foot for maintaining said collar in said recess.

* * * * *